US006558264B2

(12) United States Patent
Gordon

(10) Patent No.: US 6,558,264 B2
(45) Date of Patent: May 6, 2003

(54) INFLATABLE WEDGE FOR DIVING ONTO A WATER SLIDE

(75) Inventor: Donald W. Gordon, Draper, UT (US)

(73) Assignee: Aviva, L.L.C., Osage Beach, MO (US)

( * ) Notice: Subject to any disclaimer, the term of this patent is extended or adjusted under 35 U.S.C. 154(b) by 0 days.

(21) Appl. No.: 10/012,760

(22) Filed: Nov. 3, 2001

(65) Prior Publication Data

US 2003/0027645 A1 Feb. 6, 2003

Related U.S. Application Data

(60) Provisional application No. 60/246,147, filed on Nov. 3, 2000.

(51) Int. Cl.[7] ..... A63G 21/18
(52) U.S. Cl. ..... 472/117; 472/134
(58) Field of Search ..... 472/116, 117, 472/128, 129, 136, 137; 14/69.5; 182/48, 49

(56) References Cited

U.S. PATENT DOCUMENTS 3,032,343 A * 5/1962 Freeberg ..... 472/116
4,642,822 A * 2/1987 Tvengsberg ..... 4/488
D327,198 S 6/1992 Erker, Jr. et al.
5,154,671 A * 10/1992 Smollar et al. ..... 472/117
5,219,309 A * 6/1993 Hart ..... 441/131
5,409,411 A 4/1995 Schrieber
5,507,696 A * 4/1996 Smollar et al. ..... 472/116
5,548,851 A 8/1996 Wien et al.
5,551,922 A * 9/1996 Katz et al. ..... 4/494
D375,989 S 11/1996 Jacobs
5,678,357 A 10/1997 Rubio et al.
D407,259 S 3/1999 Jackson
6,062,983 A 5/2000 Butsook
6,406,377 B1 * 6/2002 Demko ..... 472/116

* cited by examiner

*Primary Examiner*—Kien T. Nguyen
(74) *Attorney, Agent, or Firm*—Mallinckrodt & Mallinckrodt; Robert R. Mallinckrodt

(57) ABSTRACT

A water play structure which includes an inflatable wedge which is used with a water slide. The inflatable wedge is positioned at one end of the water slide and connected to a garden hose to run lubricating water down the wedge and along the water slide. Children and adults run and dive onto the inflatable wedge which cushions their transition from a vertical running position to a horizontal sliding position down the wedge and along the water slide. An inflatable sled with gripping handles can be used to slide on for added cushioning.

17 Claims, 5 Drawing Sheets

Figure 1:
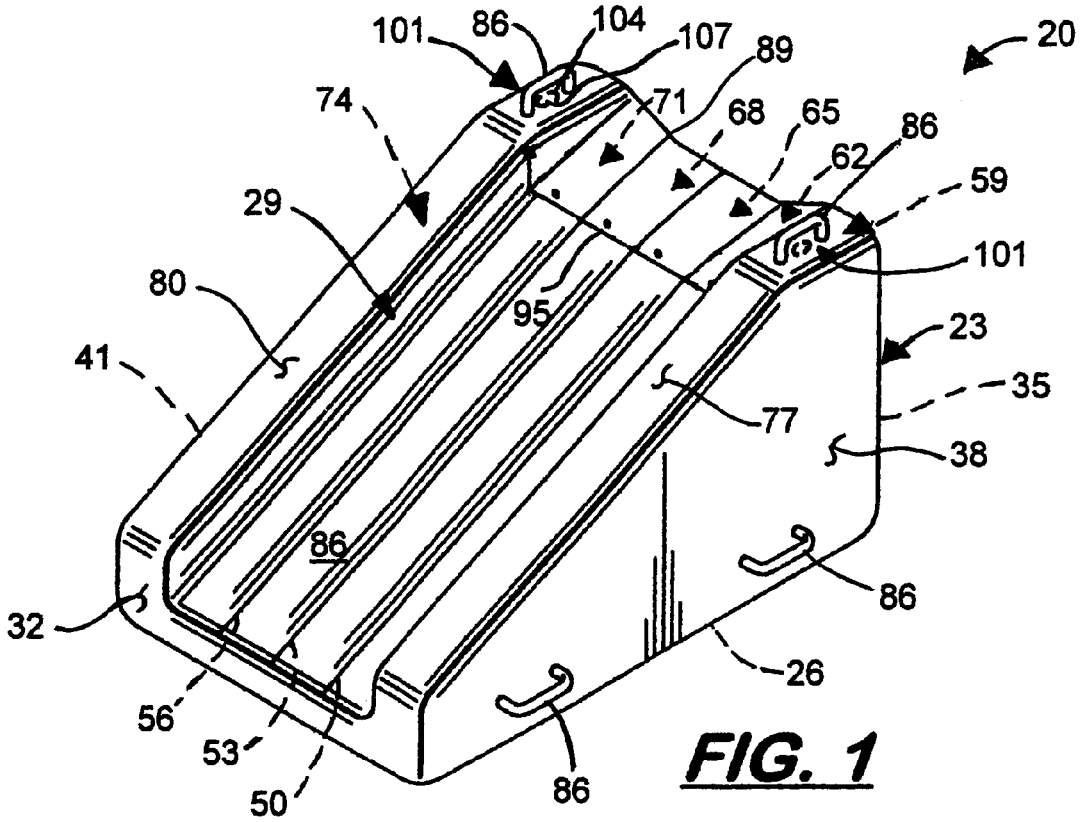

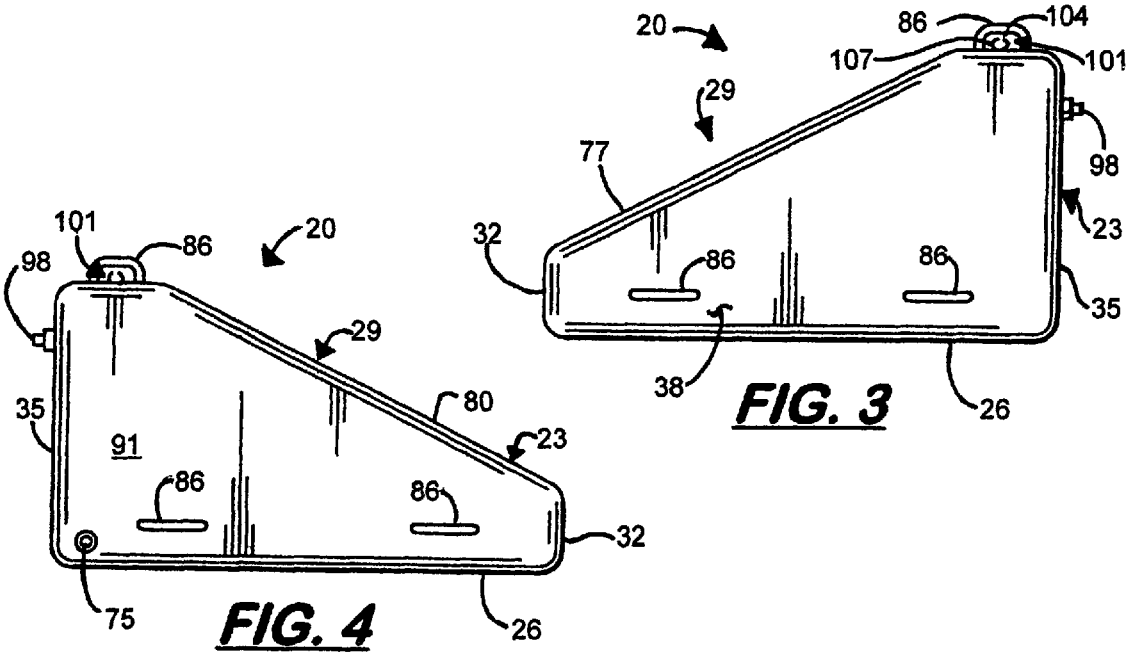
FIG. 3
FIG. 4
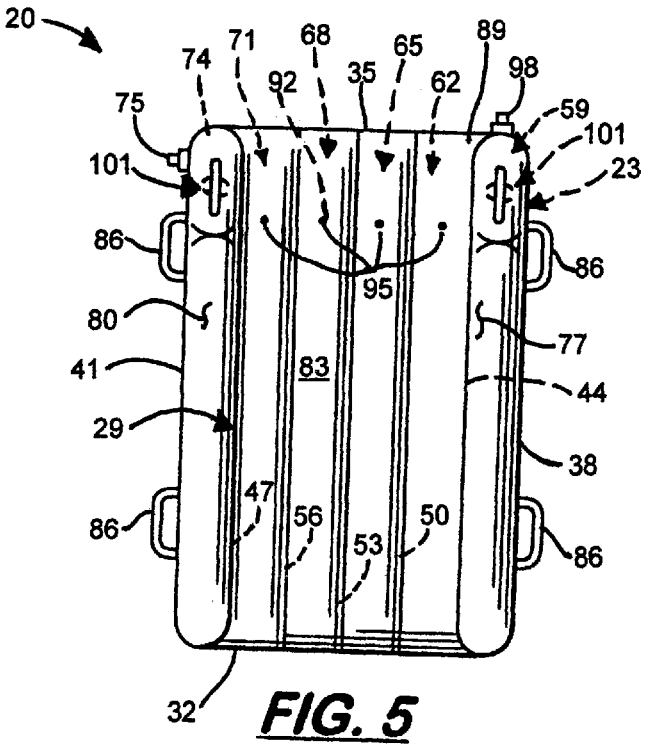
FIG. 5

INFLATABLE WEDGE FOR DIVING ONTO A WATER SLIDE

RELATED APPLICATIONS

This application claims priority of my copending U.S. Provisional Patent Application No. 60/246,147 filed Nov. 3, 2000.

BACKGROUND OF THE INVENTION

1. Field

The present invention relates to inflatable water toys and slides, and more specifically to inflatable water toys for use with a water slide.

2. State of the Art

For many years there has been on the market products generally referred to as "Slip 'n Slide"™. The product consists of a piece of thin plastic approximately thirty-six inches wide by thirty-three feet long. The plastic lays flat on the ground and uses various means of keeping the plastic wet in order to maintain a slippery surface. The participant runs to one of the narrow ends of the plastic then slides on his or her stomach or seat as far as possible. Written prominently on the a sides of the boxes containing the product as purchased is a caution that the product is not for children over twelve years old or under five years old. This is due to the inherent danger of using the slide which is the transition from vertical run to the horizontal slide, which young people are able to do easily, but wherein older people who are taller and less flexible, stand a greater chance of sustaining an injury. Hence the warning, "this product is not for adults."

SUMMARY OF THE INVENTION

The present invention is a water play structure which comprises a cushioning slide for connection to an end of a garden hose. The cushioning slide includes a wedge-shaped inflatable body with a bottom surface to rest on a support surface, a downwardly sloped upper surface along which a user can slide from a top end to a bottom end thereof, and a water emitting device. The water emitting device is connectable to the garden hose for discharging water at the top end of the upper surface to flow down to the bottom end of the upper surface to lubricate the upper surface during sliding of the user therealong.

The water play structure can further include an elongate water slide made of thin sheet plastic for use with the inflatable wedge. The water slide has an elongate sliding surface bordered by a pair of elongate sides and a pair of narrow ends of a generally similar width to the body of the inflatable wedge. The water slide is used with the inflatable wedge by placing one of the narrow ends under the lower end of the wedge such that a user can slide down from the upper surface of the wedge onto and along said sliding surface. Water from the wedge lubricates the sliding surface for ease of sliding.

The water play structure can yet further include an inflatable sled for use with the water slide and the inflatable wedge. The inflatable sled includes an inflatable body having a base and an upper surface. The body has a generally rounded front and a rear with the base and the upper surface being interconnected by peripheral wall and a plurality of internal baffles to form a plurality of individual chambers which are inflatable and deflatable using an air valve affixed to the inflatable body.

THE DRAWINGS

Figure 2:
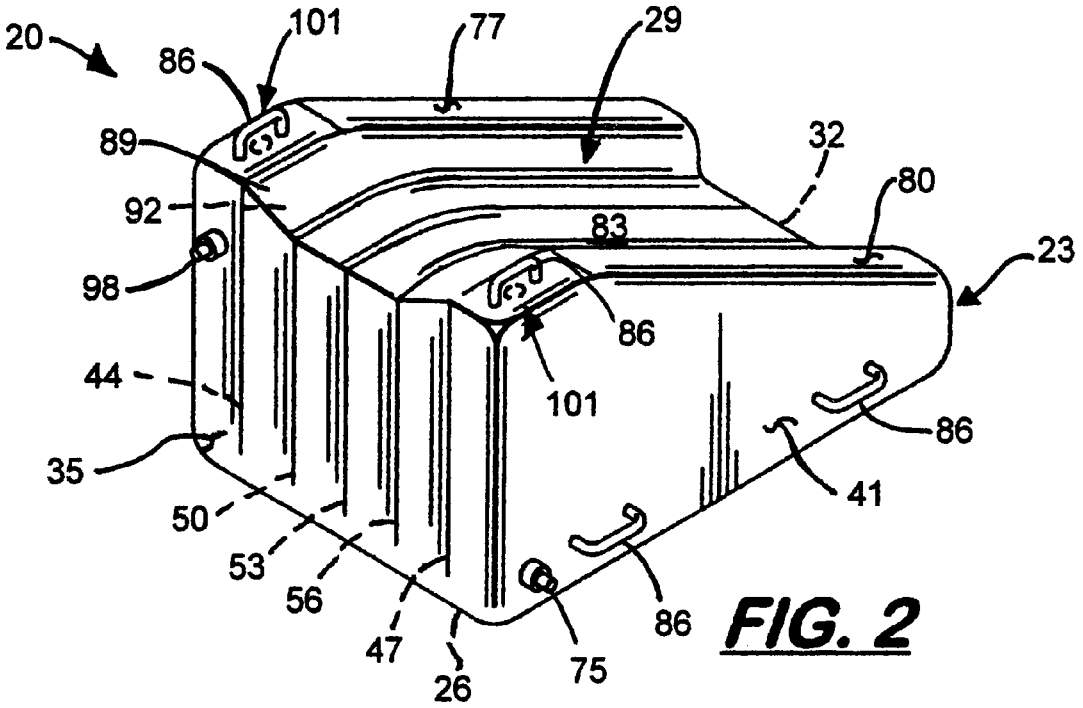
Figure 6:
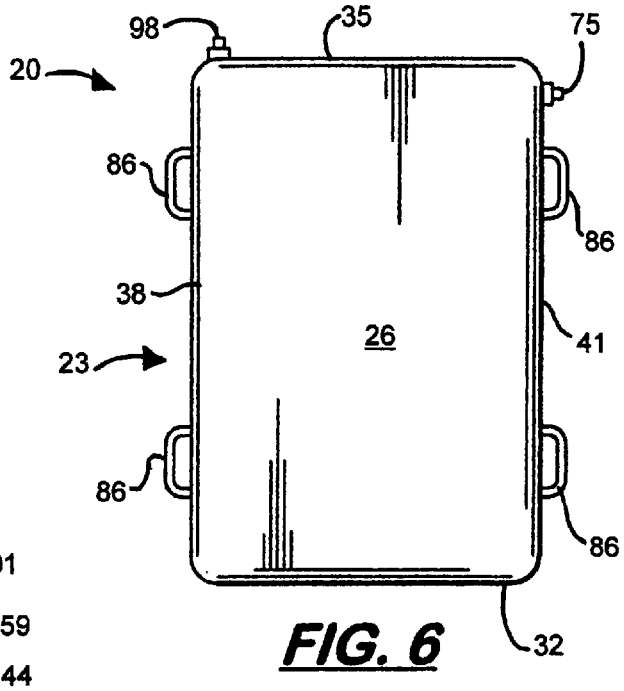
Figure 7:
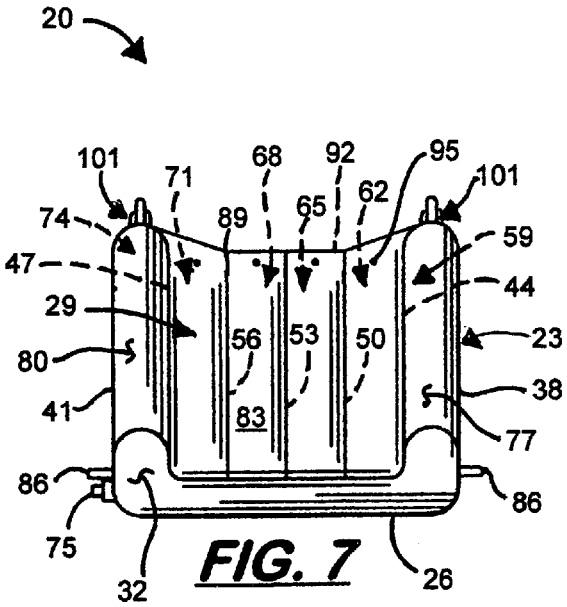
Figure 8:
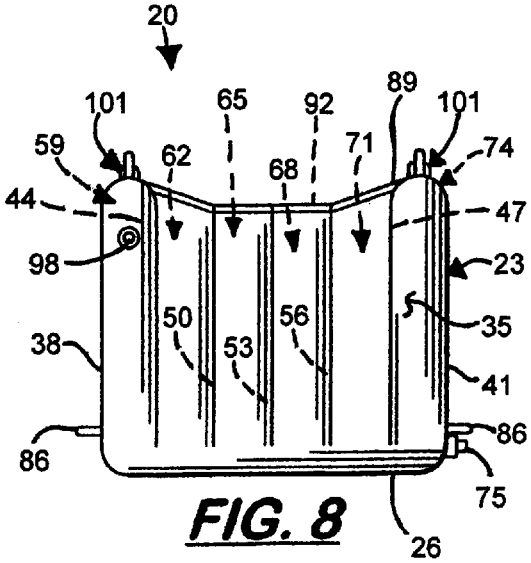
Figure 9:
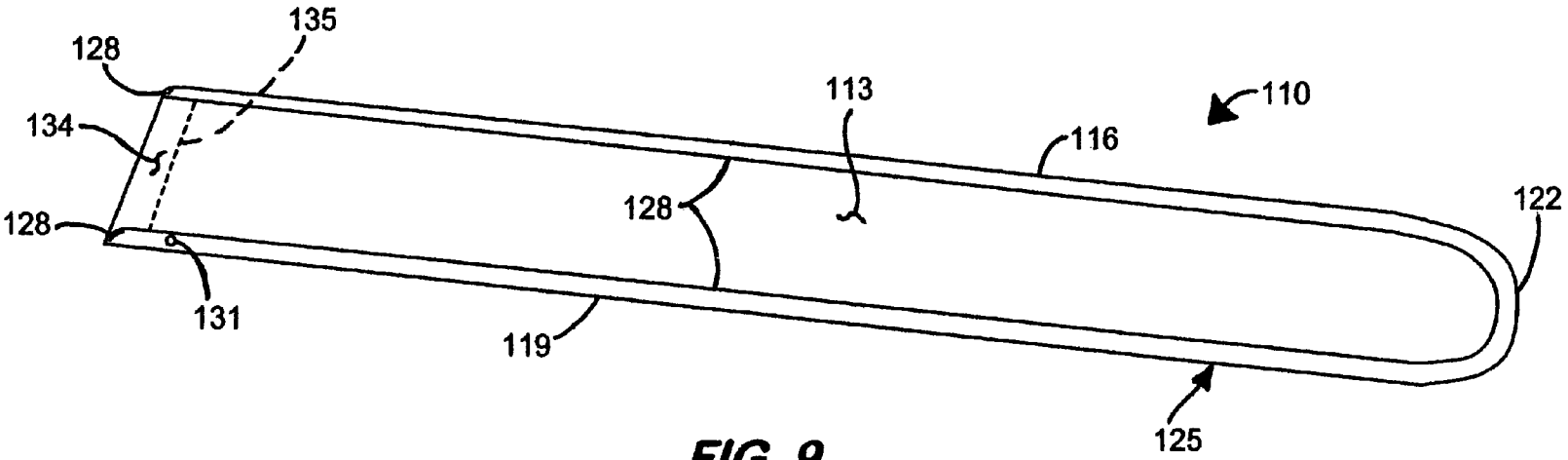
Figure 10:
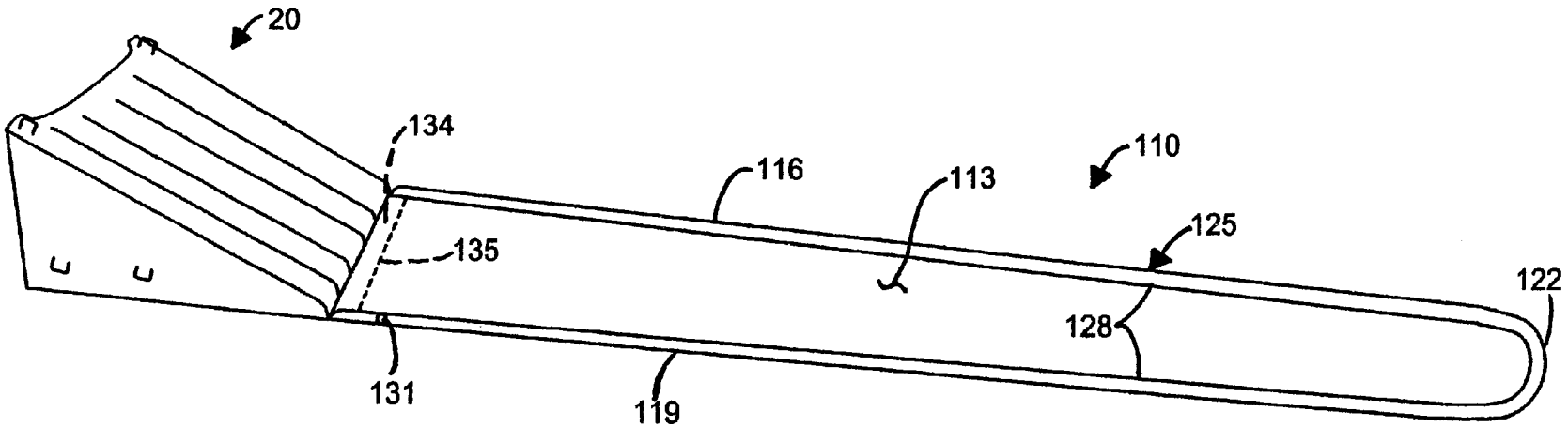
Figure 11:
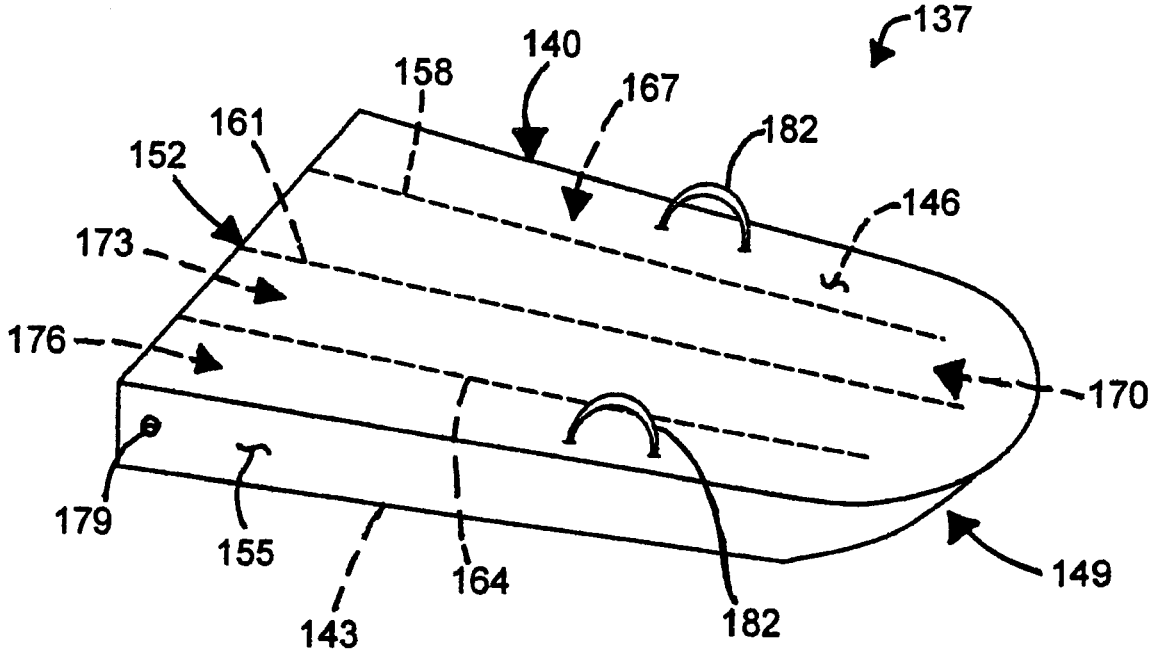

The best mode presently contemplated for carrying out the invention is illustrated in the accompanying drawings, in which:

FIG. 1 is a front quarter perspective view of an inflatable wedge according to the present invention;

FIG. 2, a rear quarter perspective view of the inflatable wedge;

FIG. 3, a right side elevational view of the inflatable wedge;

FIG. 4, a left side elevational view of the inflatable wedge;

FIG. 5, a top plan view of the inflatable wedge;

FIG. 6, a bottom plan view of the inflatable wedge;

FIG. 7, a front elevational view of the inflatable wedge;

FIG. 8, a rear elevational view of the inflatable wedge;

FIG. 9, a perspective view of a water slide for use with the inflatable wedge;

FIG. 10, a perspective view of the water slide as used with the inflatable wedge; and FIG. 11, a perspective view of an inflatable sled for use with the inflatable wedge and water slide.

DETAILED DESCRIPTION OF THE ILLUSTRATED EMBODIMENTS

An inflatable wedge shown in FIGS. 1–8, generally designated at 20, comprising an inflatable body 23 of a wedge shape having a base 26 and an inclined upper surface 29 which are interconnected by a front wall 32, a rear wall 35, and a pair of side walls 38 and 41. A plurality of side baffles 44 and 47, and middle baffles 50, 53, and 56 interconnect the base 26 to the upper surface 29 to retain the wedge shape to form a plurality of individual chambers 59, 62, 65, 68, 71, and 74. An air valve 75 permits inflation and deflation of the inflatable body 23. The side walls 38 and 41 and the side baffles 44 and 47 are slightly taller than the middle baffles 50, 53, and 56 such that a pair of side rails 77 and 80 with a sliding surface 83 therebetween are formed in the upper surface 29. A plurality of lifting handles 86 are affixed to the rear wall 35, the side walls 38 and 41, and the side rails 77 and 80. A flexible perforated tube 89 is formed in the upper surface 29 to form a transverse water chamber 92 with a plurality of water spray holes 95 and a threaded female hose connection fitting 98 respectively through the upper surface 29 and the side wall 41 in communication therewith. Alternatively to using the water chamber 92, a pair of clips 101 are provided which are affixed to the side rails 77 and 80. Each clip 101 includes a pair of resilient arcuate arms 104 and 107 between which the male coupling (not shown) of a garden hose can be retained to direct water spray therefrom onto the sliding surface 83.

A water slide 110 for use with the inflatable wedge 20 is shown in FIGS. 9. and 10, made of thin sheet plastic. The water slide 110 includes an elongate sliding surface 113 bordered on a pair of elongate sides 116 and 119, and an end 122, by a single elongate air tube 125 formed integrally with the sliding surface 113 by folding over and heat sealing at a seam 128. An air valve 131 is affixed to the air tube 125 adjacent an end 128 of the water slide 110 to permit inflating and deflating of the air tube 125. A reinforcing end flap 134 is folded over and heat sealed to the end 128 at a seam 135 to double the thickness where the inflatable wedge 20 and the water slide 110 meet. A plurality of longitudinally extending tubes (not shown) can be formed in the sliding surface 113 for added cushioning and for forming a plurality of individual water channels. The water slide is preferably made of a single sheet of high gloss plastic material, the sheet being about thirty-six to forty-eight inches wide by thirty-six to seventy-five feet long. The water slide 110 can be kept wet by the water running off the inflatable wedge 20 or by squirting with a water hose, with the air tube 125 (or a heavy seam border—not shown) enclosing the two sides and the distal end retaining a thin film of water on the sliding surface 113.

Referring to FIG. 11, therein is shown an inflatable sled 137 for use with the water slide 110 for use with the inflatable wedge 20. The inflatable sled 137 comprises an inflatable body 140 having a base 143 and an upper surface 146, the body 140 having a rounded front 149 and a squared-off rear 152. The base 143 and the upper surface 146 are interconnected by peripheral wall 155. A plurality of internal baffles 158, 161, and 164 interconnect the base 143 to the upper surface 146 to form a plurality of individual chambers 167, 170, 173, and 176. An air valve 179 permits inflation and deflation of the inflatable body 140. A pair of hand grasping handles 182 are affixed to the upper surface 146 at the rounded front 149 to aid a rider (not shown) in staying on the inflatable sled 137.

The inflatable body 23 of the inflatable wedge 20 is made of this plastic or other such flexible but durable material which is air-tight, being approximately forty to fifty inches wide, six to nine feet long, and thirty to thirty-six inches high at one side, with the size being dependent on the size and age of the users, smaller for children and larger for adults. The inflatable body 23 can be connected to the water slide 110 such as by using suitable removably fastenable devices such as respective pairs of mating hook and loop patches (not shown), or it can overlap the plastic slide sheet. Both the inflatable body 23 and water slide 110 may be anchored to the ground such as by adding lateral flaps which may be staked to the ground. The wedge can be made in one piece with the sides of the upper surface 29 being higher than at the center to prevent users from inadvertently sliding off laterally.

The inflatable wedge 20 for diving onto the water slide 210 makes it possible not only for children 5 years to 12 years of age, but also for adults and children over 12 years old to participate in this fun activity. Each participant runs toward the highest side of the wedge, and without slowing down jumps and/or falls forward onto the inflatable wedge 20, then proceeds to slide down the wedge 20 onto and along the length of the water slide 210. Long slide distances of fifty to seventy-five feet, well over twice the distance of existing water slides without the use of the inflatable wedge 20, are possible. This is because the participants can run at full speed and make the vertical to horizontal transition without initially coming into contact with the hard ground, but rather jumping onto the inflatable wedge 20. Likewise, the danger of injury to the participants is substantially reduced due to the air cushioning effect thereof. The inflatable sled 137 can be used to further cushion the user in the manner described but holding the sled 137 close to the user by grasping the handles 182.

Many variations to the present invention are possible while staying within the same inventive concept. For example; 1) the plastic sheet of the water slide may have a welded seam edge around its perimeter to hold the water on the sliding surface rather than the inflatable tube to accomplish the same purpose. If the surface on which the water slide is used is soft, such as thick grass, then the plastic sheet will form it's own groove and the inflatable tube or other such perimeter barrier is not necessary; 2) the inflatable wedge may have a separate modulated horizontal chamber with separate inflation and deflation valve at its base. This acts as a safety base should the upper main chamber suddenly fall. 3) The water slide may be made in such a fashion as to be inflatable to give the participant a cushion between him and extra hard bumps or surfaces. The thickness of the water slide could range from about one to four inches, utilizing a series of longitudinally extending baffles. The baffles also serve as reservoirs to hold the water on the upper surface of the slide.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A water play structure for connection to an end of a garden hose, comprising a cushioning slide having a wedge-shaped inflatable body with a bottom surface to rest on a support surface, a downwardly sloped upper surface along which a user can slide from a top end to a bottom end thereof, and a water emitting device connectable to the garden hose for discharging water at the top end of said upper surface to flow down to said bottom end of said upper surface to lubricate said upper surface during sliding of the user therealong.

2. The water play structure according to claim 1, wherein the water emitting device comprises a flexible perforated tube formed at the top end of the upper surface, said tube includes a connector for attaching the end of the garden hose.

3. The water play structure according to claim 1, wherein the water emitting device comprises a clip which is engagable with the end of the garden hose.

4. The water play structure according to claim 1, further comprising an elongate water slide made of thin sheet plastic for use with the inflatable wedge, having elongate sliding surface bordered by a pair of elongate sides and a pair of narrow ends of a generally similar width to the body of said inflatable wedge, said water slide being usable with said one of said narrow ends disposed under the lower end of the wedge such that a user can slide down from the upper surface of said wedge onto and along said sliding surface, water from said wedge which lubricates said sliding surface.

5. The water play structure according to claim 4, wherein at least the sides of the water slide comprise respective inflatable cushioning side air tubes inflatable through an air valve, forming a water and user directing channel therebetween.

6. The water play structure according to claim 4, wherein one end of the water slide includes a reinforcing end flap which is doubled over and sealed to form a double thickness area for use adjacent the wedge.

7. The water play structure according to claim 4, wherein at least one end of the water slide comprises an inflatable cushioning end air tube, which joins the side air tubes to form a single elongate U-shaped air tube.

8. The water play structure according to claim 4, wherein a plurality of elongate air tubes extend side-by-side below the sliding surface of the water slide defining a plurality of longitudinal water channels in said sliding surface.

9. A water play structure for connection to an end of a garden hose, comprising a cushioning slide having a wedge-shaped inflatable body with a bottom surface to rest on a support surface, a downwardly sloped upper surface along which a user can slide from a top end to a bottom end thereof, and a water emitting device comprising a clip which is engagable with the end of the garden hose for discharging water at the top end of said upper surface to flow down to said bottom end of said upper surface to lubricate said upper surface during sliding of the user therealong, said clip having a pair of arcuate arms which extend from a base affixed to the top end of the upper surface.

10. A water play structure for connection to an end of a garden hose, comprising a cushioning slide having a wedge-shaped inflatable body with a bottom surface to rest on a support surface, a downwardly sloped upper surface along which a user can slide from a top end to a bottom end thereof, and a water emitting device comprising a pair of clips, one at each respective side of the upper surface, which are engagable with the end of the garden hose for discharging water at the top end of said upper surface to flow down to said bottom end of said upper surface to lubricate said upper surface during sliding of the user therealong.

11. A water play structure for connection to an end of a garden hose, comprising a cushioning slide having a wedge-shaped inflatable body with a bottom surface to rest on a support surface, a downwardly sloped upper surface along which a user can slide from a top end to a bottom end thereof, a plurality of generally vertically disposed baffles which interconnect the base to the upper surface to retain the inflatable body in a wedge shape, and a water emitting device connectable to the garden hose for discharging water at the top end of said upper surface to flow down to said bottom end of said upper surface to lubricate said upper surface during sliding of the user therealong.

12. The water play structure according to claim 11, wherein the baffles form a plurality of interconnected vertically disposed chambers which are fillable through an air valve affixed to the body.

13. The water play structure according to claim 12, wherein the inflatable body includes a horizontally disposed baffle forming a lower horizontally disposed chamber which is separately inflatable and deflatable from respective upper vertically disposed chambers.

14. The water play structure according to claim 11, wherein respective side baffles of the plurality of baffles, and respective sides of the inflatable body are slightly taller than a remaining plurality of said plurality of baffles, such that the upper surface comprises a pair of side rails with a sliding surface therebetween.

15. A water play structure for connection to an end of a garden hose, comprising a cushioning slide having a wedge-shaped inflatable body with a bottom surface to rest on a support surface, a downwardly sloped upper surface along which a user can slide from a top end to a bottom end thereof, and a water emitting device connectable to the garden hose for discharging water at the top end of said upper surface to flow down to said bottom end of said upper surface to lubricate said upper surface during sliding of the user therealong; an elongate water slide made of thin sheet plastic and having an elongate sliding surface bordered by a pair of elongate sides and a pair of narrow ends of a generally similar width to the body of said inflatable wedge, said water slide being usable with said one of said narrow ends disposed under the lower end of the wedge such that a user can slide down from the upper surface of said wedge onto and along said sliding surface, water from said wedge lubricating said sliding surface; and an inflatable sled for use with the water slide and the inflatable wedge, said inflatable sled which includes an inflatable body having a base and an upper surface, said body having a generally rounded front and a rear, said base and said upper surface being interconnected by peripheral wall and a plurality of internal baffles to form a plurality of individual chambers which are inflatable and deflatable using an air valve affixed to said inflatable body.

16. The water play structure according to claim 15, wherein the rounded front end of the inflatable sled is upwardly beveled to plow through the water.

17. The water play structure according to claim 15, wherein the inflatable sled includes a pair of hand grasping handles which are affixed to the upper surface at the rounded front.

* * * * *

US006558264C1

(12) EX PARTE REEXAMINATION CERTIFICATE (8663rd)

United States Patent
Gordon

(10) Number: US 6,558,264 C1
(45) Certificate Issued: Nov. 15, 2011

(54) INFLATABLE WEDGE FOR DIVING ONTO A WATER SLIDE

(75) Inventor: David W. Gordon, Draper, UT (US)

(73) Assignee: Aviva Sports, Inc., Montreal, MO (US)

Reexamination Request:
No. 90/009,690, Feb. 19, 2010

Reexamination Certificate for:

| | |
|---|---|
| Patent No.: | **6,558,264** |
| Issued: | **May 6, 2003** |
| Appl. No.: | **10/012,760** |
| Filed: | **Nov. 3, 2001** |

Related U.S. Application Data

(60) Provisional application No. 60/246,147, filed on Nov. 3, 2000.

(51) Int. Cl.
*A63G 21/18* (2006.01)

(52) U.S. Cl. ..... 472/117; 472/134

(58) Field of Classification Search ..... 472/117
See application file for complete search history.

(56) References Cited

To view the complete listing of prior art documents cited during the proceeding for Reexamination Control Number 90/009,690, please refer to the USPTO's public Patent Application Information Retrieval (PAIR) system under the Display References tab.

*Primary Examiner*—Glenn K. Dawson

(57) ABSTRACT

A water play structure which includes an inflatable wedge which is used with a water slide. The inflatable wedge is positioned at one end of the water slide and connected to a garden hose to run lubricating water down the wedge and along the water slide. Children and adults run and dive onto the inflatable wedge which cushions their transition from a vertical running position to a horizontal sliding position down the wedge and along the water slide. An inflatable sled with gripping handles can be used to slide on for added cushioning.

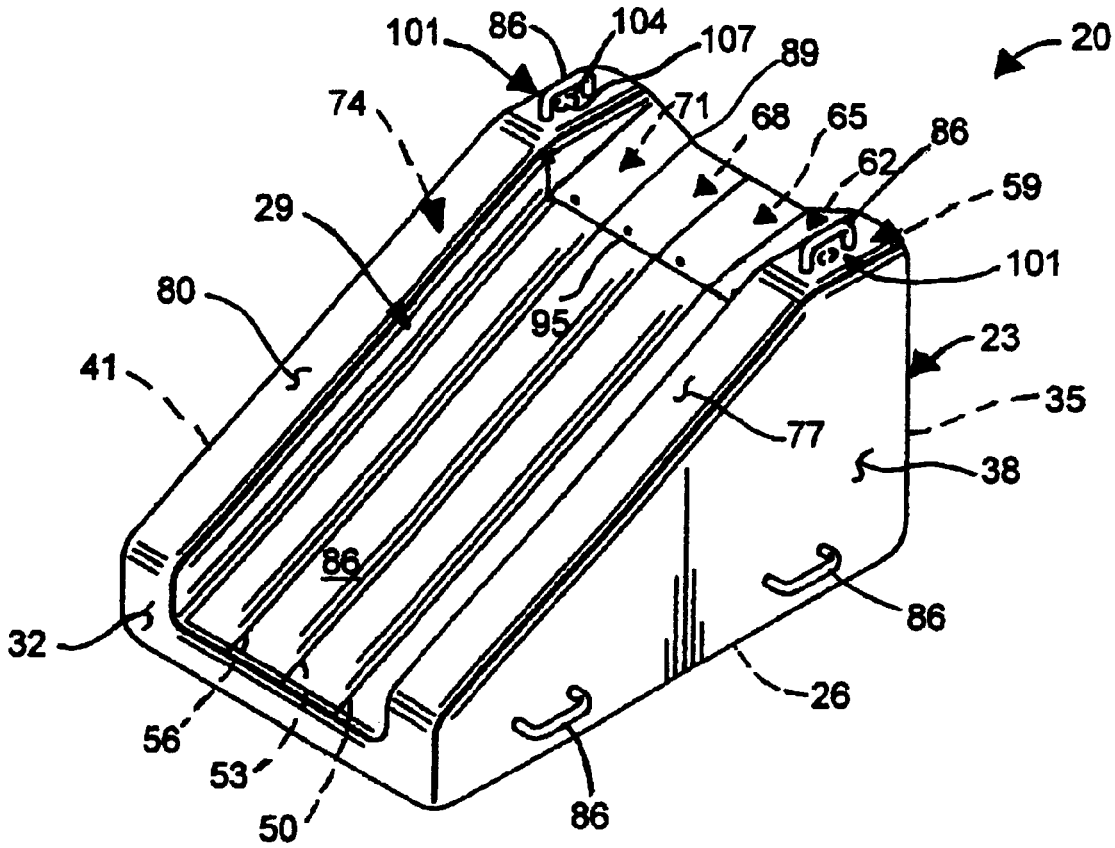

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 13 and 14 is confirmed.

Claims 1-12 and 15-17 are cancelled.

New claims 18 and 19 are added and determined to be patentable.

*18. A ground supported water play structure for connection to an end of a garden hose, comprising a cushioning slide having a wedge-shaped inflatable body with a bottom surface to rest on a support surface comprising the ground, a downwardly sloped upper surface having a sliding portion along which a user can slide from a top end to a bottom end thereof, and a water emitting device connectable to the garden hose for discharging water at the top end of said upper surface to flow down to said bottom end of said upper surface to lubricate said upper surface during sliding of the user therealong, wherein the wedge-shaped inflatable body further has a plurality of substantially vertical walls com-*

*prising a front wall, a pair of laterally spaced side walls and a rear wall that connect the bottom surface and the upper surface together, wherein the rear wall is substantially taller than the front wall and each side wall has a wedge shape to provide the wedge-shape of the inflatable body, wherein the rear wall when viewed in a rear elevational view of the wedge-shaped body has a sliding portion approach area thereon extending upwardly from the bottom surface to the top end of the upper surface and extending laterally from one side of the sliding portion of the upper surface to an opposite side of the sliding portion of the upper surface, wherein the inflatable body when inflated is free standing and self-supporting on the ground with the entirety of the sliding portion approach area of the rear wall being substantially completely exposed to a user, and wherein no portion of the water play structure is located behind the rear wall in a position that is within the sliding portion approach area of the rear wall such that a user who runs on the ground straight ahead towards the sliding portion approach area of the rear wall of the inflatable body has unimpeded access to the sliding portion approach area of the rear wall from the ground and is able to come up to the sliding portion approach area of the rear wall while running on the ground to transition directly from a running position on the ground immediately behind the sliding portion approach area of the rear wall to a sliding position atop the sliding portion of the upper surface without having to first step over or climb up any other portion of the water play structure.*

*19. The water play structure of claim 18, wherein the upper surface of the body includes a pair of raised side rails with the sliding portion of the upper surface being that portion of the upper surface disposed between the raised side rails.*

* * * * *

US006558264C2

(12) EX PARTE REEXAMINATION CERTIFICATE (10372nd)

United States Patent
Gordon

(10) Number: US 6,558,264 C2
(45) Certificate Issued: Oct. 30, 2014

(54) INFLATABLE WEDGE FOR DIVING ONTO A WATER SLIDE

(75) Inventor: Donald W. Gordon, Draper, UT (US)

(73) Assignee: Aviva Sports, Inc., Montreal, MO (US)

Reexamination Request:
No. 90/009,984, Feb. 3, 2012
No. 90/012,181, Mar. 8, 2012

Reexamination Certificate for:

| | |
|---|---|
| Patent No.: | **6,558,264** |
| Issued: | **May 6, 2003** |
| Appl. No.: | **10/012,760** |
| Filed: | **Nov. 3, 2001** |

Reexamination Certificate C1 6,558,264 issued Nov. 15, 2011

Related U.S. Application Data

(60) Provisional application No. 60/246,147, filed on Nov. 3, 2000.

(51) Int. Cl.
*A63G 21/00* (2006.01)
*A63G 21/18* (2006.01)

(52) U.S. Cl.
USPC ..... 472/117; 472/134

(58) Field of Classification Search
None
See application file for complete search history.

(56) References Cited

To view the complete listing of prior art documents cited during the proceedings for Reexamination Control Numbers 90/009,984 and 90/012,181, please refer to the USPTO's public Patent Application Information Retrieval (PAIR) system under the Display References tab.

*Primary Examiner* — Peter C. English

(57) ABSTRACT

A water play structure which includes an inflatable wedge which is used with a water slide. The inflatable wedge is positioned at one end of the water slide and connected to a garden hose to run lubricating water down the wedge and along the water slide: Children and adults run and dive onto the inflatable wedge which cushions their transition from a vertical running position to a horizontal sliding position down the wedge and along the water slide. An inflatable sled with gripping handles can be used to slide on for added cushioning.

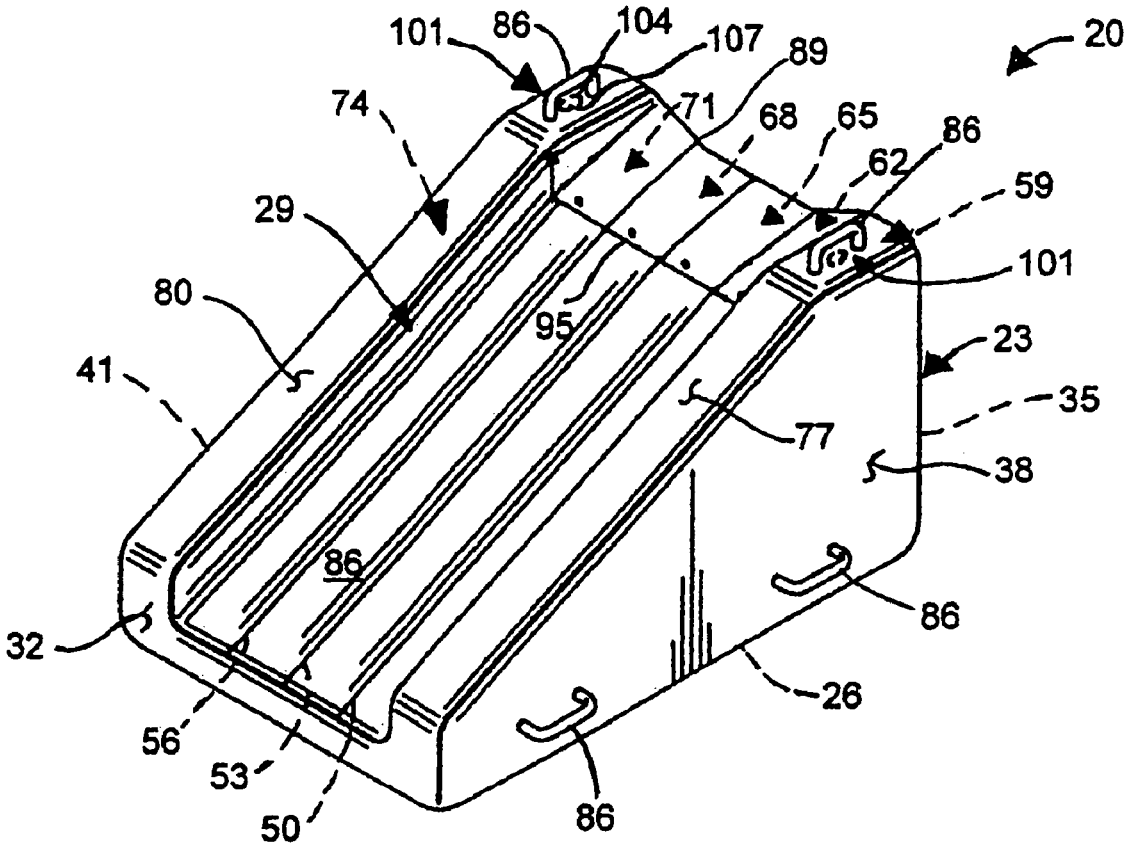

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 13 is confirmed.

Claims 1-12 and 15-17 were previously cancelled.

Claims 14, 18 and 19 are cancelled.

* * * * *